US008720802B2

(12) United States Patent
Kerst et al.

(10) Patent No.: US 8,720,802 B2
(45) Date of Patent: May 13, 2014

(54) FUEL INJECTION VALVE FOR INTERNAL COMBUSTION ENGINES

(75) Inventors: Andreas Kerst, Stuttgart (DE); Gerhard Suenderhauf, Calw (DE); Roland Schulz, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/908,673

(22) PCT Filed: Apr. 6, 2006

(86) PCT No.: PCT/EP2006/061400

§ 371 (c)(1),
(2), (4) Date: Sep. 14, 2007

(87) PCT Pub. No.: WO2006/128756

PCT Pub. Date: Dec. 7, 2006

(65) Prior Publication Data

US 2008/0142621 A1 Jun. 19, 2008

(30) Foreign Application Priority Data

Jun. 1, 2005 (DE) ..... 10 2005 025 135

(51) Int. Cl.
*B05B 1/30* (2006.01)
*B05B 1/34* (2006.01)
*F02M 51/00* (2006.01)

(52) U.S. Cl.
USPC ..... 239/533.3; 239/533.9; 239/533.12; 239/585.5

(58) Field of Classification Search
CPC ..... B05B 1/30; B05B 1/34; B05B 1/3452; B05B 1/3442; F02M 51/00
USPC ..... 239/533.12, 585.5, 533.2, 533.3, 533.8, 239/533.9, 533.11, 533.1, 533.4, 533.5, 239/533.6, 533.7, 585, 584.4, 585.1, 584, 239/88–91, 585.2, 585.3, 585.4; 123/506, 123/299, 446, 447, 467, 468
See application file for complete search history.

(56) References Cited

U.S. PATENT DOCUMENTS 4,083,498 A * 4/1978 Cavanagh et al. ..... 239/533.3
4,200,237 A * 4/1980 Urlaub et al. ..... 239/533.12
4,819,871 A * 4/1989 Kronberger et al. ..... 239/533.3

(Continued)

FOREIGN PATENT DOCUMENTS

EP 1422 418 A1 5/2004
EP 1129287 B1 5/2005

(Continued)

*Primary Examiner* — Justin Jonaitis
(74) *Attorney, Agent, or Firm* — Michael Best & Friedrich LLP

(57) ABSTRACT

The invention relates to a fuel injection valve for internal combustion engines having a valve body in which a blind hole is formed, with at least one injection opening proceeding from said blind hole. A longitudinally displaceable needle in the valve body has a valve sealing face formed at its end which faces towards the blind hole. The valve sealing face is formed from one or more conical faces, and the valve needle interacting, by means of a body seat, with said valve sealing face to control a fuel flow to the at least one injection opening. A needle tip adjoining the valve sealing face dips into the blind hole when the valve needle bears against the body seat, the needle tip being curved in a concave fashion directly adjacent to the valve sealing face.

6 Claims, 2 Drawing Sheets

(56) References Cited

U.S. PATENT DOCUMENTS

| | | | | |
|---|---|---|---|---|
| 5,224,458 | A * | 7/1993 | Okada et al. | 123/531 |
| 5,743,470 | A * | 4/1998 | Schlaf et al. | 239/533.4 |
| 6,186,419 | B1 * | 2/2001 | Kampmann et al. | 239/533.3 |
| 6,427,932 | B1 * | 8/2002 | Danckert et al. | 239/533.12 |
| 6,892,965 | B2 * | 5/2005 | Haeberer et al. | 239/533.12 |
| 7,017,840 | B2 * | 3/2006 | Kruger et al. | 239/584 |
| 7,128,280 | B1 * | 10/2006 | Boecking | 239/533.12 |
| 7,306,169 | B2 * | 12/2007 | Matsumura | 239/88 |
| 7,347,389 | B2 * | 3/2008 | Ohnmacht et al. | 239/584 |
| 7,360,722 | B2 * | 4/2008 | Stockner et al. | 239/533.12 |
| 2002/0179743 | A1 * | 12/2002 | Haeberer et al. | 239/533.12 |
| 2003/0057299 | A1 * | 3/2003 | Itoh | 239/533.3 |
| 2005/0178860 | A1 * | 8/2005 | Christ et al. | 239/533.12 |
| 2006/0011749 | A1 * | 1/2006 | Kuegler et al. | 239/533.12 |
| 2007/0051828 | A1 * | 3/2007 | Cooke | 239/102.2 |
| 2009/0139487 | A1 * | 6/2009 | Dingle | 123/445 |
| 2013/0008983 | A1 * | 1/2013 | Soteriou et al. | 239/584 |

FOREIGN PATENT DOCUMENTS

| | | | |
|---|---|---|---|
| EP | 1 598 550 | A1 | 11/2005 |
| WO | WO 99/58844 | A1 | 11/1999 |
| WO | WO 01/18387 | A1 | 3/2001 |
| WO | WO 0118387 | A1 * | 3/2001 |
| WO | WO 02/01066 | A1 | 1/2002 |
| WO | WO 03/031803 | A1 | 4/2003 |
| WO | WO 2006/040288 | A1 | 4/2006 |

* cited by examiner

FUEL INJECTION VALVE FOR INTERNAL COMBUSTION ENGINES

CROSS-REFERENCE TO RELATED APPLICATION

This application is a 35 USC 371 application of PCT/EP 2006/061400 filed on Apr. 6, 2006.

BACKGROUND OF THE INVENTION

1. Field of the Invention

This invention relates to an improved fuel injection valve for an internal combustion engine.

2. Description of the Prior Art

Known injection valves that are used for direct fuel injection into the combustion chamber of an internal combustion engine are generally provided with several injection openings, but are at least provided with one injection opening. The fuel injection valves control the injection of compressed and therefore pressurized fuel by the longitudinal movement of a valve needle that has a valve sealing surface and cooperates with a body seat. A distinction is drawn here between essentially two basic types: on the one hand, there are the so-called valve covered orifice nozzles in which the injection openings lead directly from a conical body seat and on the other hand, there are the so-called blind hole nozzles in which the injection openings lead from a blind hole. The blind hole nozzles have the advantage over valve covered orifice nozzles that the distribution of fuel to the individual injection openings occurs in a uniform fashion, generally achieving a more uniform injection pattern than in valve covered orifice nozzles. In blind hole nozzles, however, the problem arises that the fuel that travels between the valve sealing surface and the body seat is subjected to turbulence as it transitions into the blind hole, thus reducing the effective injection pressure at the injection openings.

DE 36 05 082 A1 has disclosed a fuel injection valve that functions in accordance with the principle of the blind hole nozzle. In this case, the valve needle is provided with a needle tip that protrudes into the blind hole even in the open position of the valve needle, i.e. when the needle has lifted away from the body seat. The needle tip has a conical sealing surface with which the valve needle rests against the body seat. This sealing surface is adjoined by a convex, i.e. outwardly arched, region, which, in turn transitions into a concave, i.e. inwardly arched, region. The end of the valve needle thus constitutes a dome that is also arched outward and tangentially adjoins the concave region. This shape of the valve sealing surface is supposed to deflect the fuel flow into the blind hole without causing it to detach from the needle tip in order to avoid turbulence. But in his case, the disadvantage arises that the form of the needle tip cannot be adapted equally well to all injection ports since as a rule, they enclose various angles with the longitudinal axis of the valve needle. This results in an optimized entry for only some ports, while the surface flow travels into other injection openings in a rather unfavorable fashion.

SUMMARY AND ADVANTAGES OF THE INVENTION

The fuel injection valve according to the invention has the advantage over the prior art of optimizing the entry of the fuel into the blind hole and therefore optimizing the effective injection pressure at the injection openings. To this end, the valve needle has a conical valve sealing surface and a valve needle tip adjoining it; the valve needle tip is arched in concave fashion directly adjacent to the conical valve sealing surface. The fuel flow therefore detaches from the valve needle at the entry into the blind hole and is then deflected by the part of the needle tip situated farther downstream so that the fuel leaves the injection openings at a high speed and therefore with a high effective injection pressure.

Advantageous embodiments of the subject of the invention are possible. In a first advantageous embodiment, at the transition from the conical body seat to the blind hole, an edge is embodied, which, in combination with the embodiment of the needle tip, further optimizes the entry of the fuel into the blind hole. This embodiment is particularly advantageous when the blind hole has a conical wall from which the injection openings lead.

In another advantageous embodiment, the needle tip extends into the blind hole so far that the concave needle tip reaches to the depth of the injection openings even when the valve needle is in its open position. This makes it possible to further optimize the deflection if this is indicated by corresponding proportions and pressure ratios in the blind hole.

In another advantageous embodiment, the concave needle tip is adjoined by an arched dome that constitutes the end of the valve needle. Depending on how far the valve needle protrudes into the blind hole, this can reduce turbulence in the blind hole.

BRIEF DESCRIPTION OF THE DRAWINGS

An exemplary embodiment of the fuel injection valve according to the invention is described more fully herein below, with reference to the drawings, in which.

DESCRIPTION OF THE PREFERRED EMBODIMENT

Figure 1:
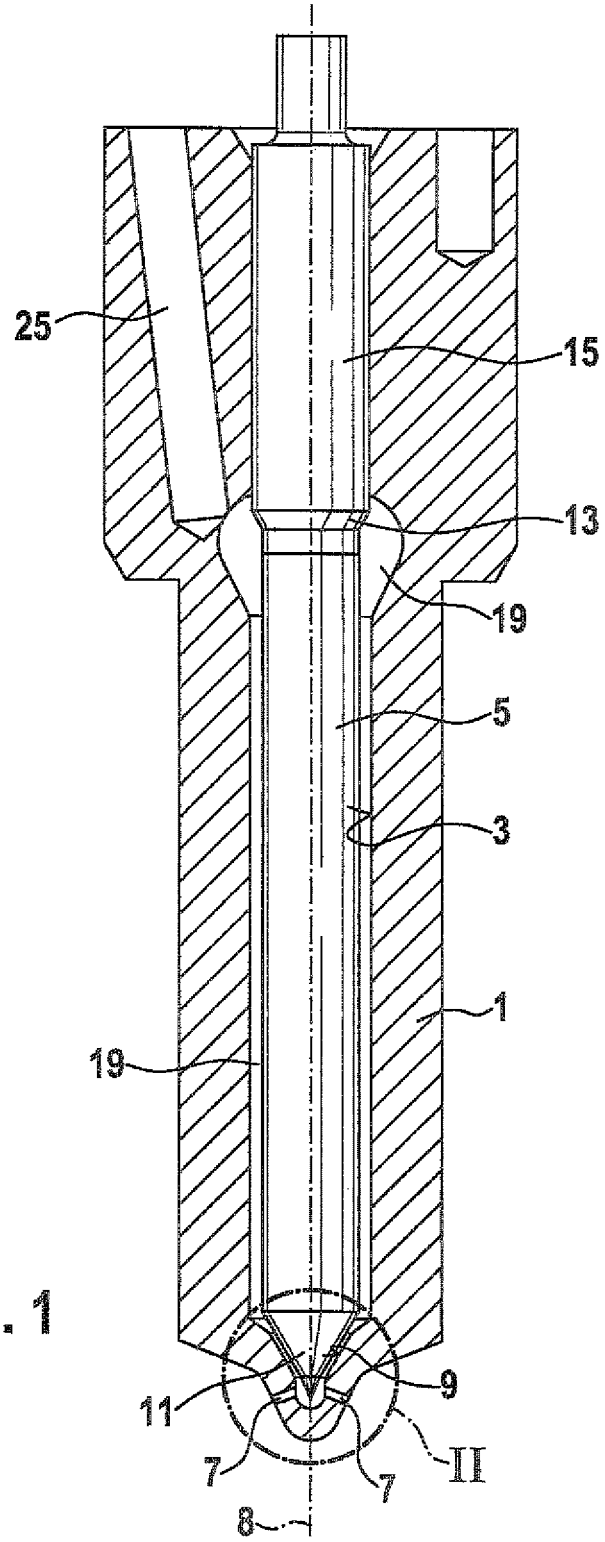
FIG. 1 shows a longitudinal section through a fuel injection valve with its essential components and FIG. 2 is an enlarged depiction of the detail labeled II in FIG. 1, in the region of the body seat.

FIG. 1 is a longitudinal section through a fuel injection valve according to the invention depicting only the essential components. The fuel injection valve has a valve body 1 that contains a bore 3 with a longitudinal axis 8; a body seat 9 delimits the bore 3 at its combustion chamber end. The body seat 9 is adjoined by a blind hole 10 (FIG. 2) from which at least one injection opening 7 leads; usually several injection openings 7 are provided, which are distributed around the circumference of the blind hole 10. In this case, it is also possible for the individual injection openings 7 to have different inclination angles in relation to the bore 3. Inside the bore 3, a piston-shaped valve needle 5 is provided, which is able to move longitudinally and is guided in a sealed fashion in a guide section 15 inside the bore 3. Starting from the guide section 15, the valve needle 5 tapers toward the body seat 9 to form a pressure shoulder 13 and at its end oriented toward the body seat, finally transitions into a valve sealing surface 11. The end of the valve needle 5 forms a needle tip 30 (FIG. 2) that protrudes into the blind hole 10 when the valve needle 5 is resting against the body seat 9. Between the wall of the bore 3 and the valve needle 5, a pressure chamber 19 is formed, which expands radially at the level of the pressure shoulder 13. The radial expansion of the pressure chamber 19 is fed by a supply conduit 25, which is contained in the valve body 1 and is able to fill the pressure chamber 19 with highly pressurized fuel.

At its end oriented away from the body seat, the valve needle 5 is acted on by a closing force oriented in the direction of the body seat 9 and is generated, for example, by means of a spring element or by hydraulic means. The valve needle 5 moves longitudinally inside the bore 3 as a function of the ratio of this closing force to the hydraulic opening force, which is essentially generated by the impingement of pressure on the pressure shoulder 13. If the valve needle 5 is resting against the body seat 9, then the blind hole 10 is closed in relation to the pressure chamber 19. But if an injection of fuel is to take place, then the valve needle 5 is moved away from the body seat 9 either through a pressure increase in the pressure chamber 19 or through a reduction in the closing force. As a result, fuel flows between the valve sealing surface 11 and the body seat 9, into the blind hole 10 from which the fuel is injected via the injection openings 7.

Figure 2:
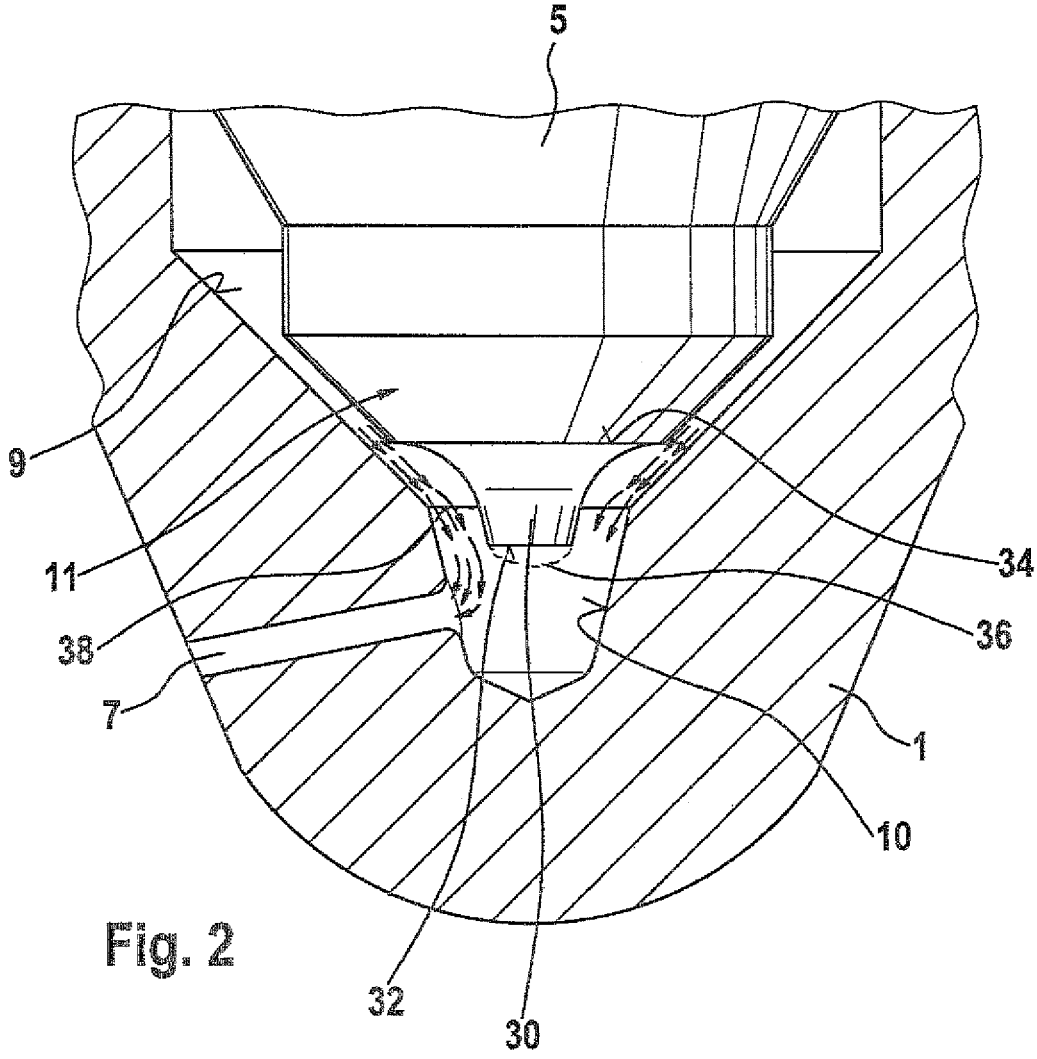

FIG. 2 is an enlarged depiction of the detail labeled II in FIG. 1, in the region of the body seat 9. The valve sealing surface 11 is embodied as conical; it is also possible, in lieu of one conical surface, to provide two or more conical surfaces with slightly different angles; all of the opening angles of these conical surfaces as well as the opening angle of the valve sealing surface 11 are essentially equivalent to the opening angle of the likewise conical body seat 9. The conical valve sealing surface 11 is adjoined by a needle tip 30 that protrudes into the blind hole 10, even in the open position of the valve needle 5 as depicted in FIG. 2. Directly adjacent to the valve sealing surface 11, the needle tip 30 is concave, i.e. arched inward, so that an edge 34 is formed between the valve sealing surface 11 and the needle tip 30. The needle tip 30 can end with a flat end surface 32 as shows in FIG. 2 or a dome 36, which is indicated with a dashed line in FIG. 2. This depends on how far the needle tip 30 protrudes into the blind hole 10, allowing the dome 36 to achieve a certain calming of the flow in the blind hole 10.

When fuel flows out of the pressure chamber 19, between the valve sealing surface 11 and the body seat 9, and into the blind hole 10 during an injection, the flow accelerates on its way into the blind hole 10 since the available flow cross section continuously decreases. In the process, the fuel flows past the edge 34; due to the concave formation of the needle tip here, the flow detaches from the valve needle 5 at the edge 34. This is indicated by small arrows in FIG. 2. The fuel flow then comes back into contact with the needle tip 30 inside the blind hole 10 and is effectively deflected by it in the direction of the injection openings 7. This minimizes the energy loss in the deflection, which yields a higher final effective injection pressure available inside the injection opening 7. This also calms the flow inside the blind hole 10, yielding a further increase in the effective injection pressure.

The above-described effect achieved by means of the needle tip 30 can be further optimized by providing an inlet edge 38 between the body seat 9 and the blind hole 10 at which edge the fuel flow also detaches to a certain degree from the wall of the valve body 1. The inlet edge 38 is particularly provided when the wall of the blind hole 10 is conically embodied, as is also shown in FIG. 2.

The detachment of the flow does not mean that the other regions in the blind hole 10 and against the valve sealing surface 11 constitute dead zones in which no flow occurs. Rather, the above description of the flow detachment means that the main flow with the highest flow speeds takes the described path; this maximum flow speed essentially determines the injection pressure.

It is also possible for the needle tip 30 to be of such a length that it extends to the level of the injection openings 7. This can contribute to an improved deflection of the fuel into the injection openings 7, depending on the dimensions of the blind hole 10 and the injection pressure used.

The foregoing relates to a preferred exemplary embodiment of the invention, it being understood that other variants and embodiments thereof are possible within the spirit and scope of the invention, the latter being defined by the appended claims.

What is claimed is:

1. In a fuel injection valve for internal combustion engines, comprising:

a valve body that contains a blind hole from which at least one injection opening leads;

a valve needle that is able to move longitudinally in the valve body and whose end oriented toward the blind hole is provided with a valve sealing surface with which the valve needle cooperates with a body seat in order to control a fuel flow to the at least one injection opening; and a needle tip that adjoins the valve sealing surface and extends into the blind hole when the valve needle is resting against the body seat, wherein the needle tip is arched in a concave fashion along the entire length of the needle tip from an end of the needle tip adjoining the valve sealing surface to an end of the needle tip where the needle tip terminates, wherein the concave needle tip is adjoined by a flat end surface.

2. The fuel injection valve as recited in claim 1, wherein the concavity of the needle tip is shaped so that the fuel flow that travels between the valve sealing surface and the body seat detaches from the valve needle at the transition from the valve sealing surface to the needle tip.

3. The fuel injection valve as recited in claim 1, further comprising an edge embodied at the transition from the body seat to the blind hole, the edge being situated at the level of the needle tip when the valve needle is lifted away from the body seat.

4. The fuel injection valve as recited in claim 1, wherein a plurality of injection openings are provided, which lead from the blind hole.

5. The fuel injection valve as recited in claim 4, wherein the blind hole has a conical wall that directly adjoins the body seat.

6. The fuel injection valve as recited in claim 1, wherein the valve sealing surface is composed of one or more conical surfaces.

* * * * *